United States Patent [19]

Strongwater

[11] Patent Number: 4,825,563

[45] Date of Patent: May 2, 1989

[54] SHOE PROTECTOR

[76] Inventor: Murray Strongwater, 326 Hewlett Neck Rd., Woodmere, N.Y. 11598

[21] Appl. No.: 134,087

[22] Filed: Dec. 17, 1987

[51] Int. Cl.[4] ..... A43B 23/30; A43B 13/22

[52] U.S. Cl. ..... 36/73; 36/72 R; 36/72 B; 36/71 R

[58] Field of Search ..... 36/72 R, 72 B, 73, 71.5, 36/7.1 R, 7.2, 7.3, 7.5

[56] References Cited

U.S. PATENT DOCUMENTS

| | | | |
|---|---|---|---|
| 249,668 | 11/1881 | Piles | 36/7.2 |
| 419,506 | 1/1890 | Douglass | 36/7.5 |
| 1,304,593 | 5/1919 | Parmenter | 36/7.2 |
| 1,620,935 | 3/1927 | Arnsberg | 36/72 B |
| 1,770,261 | 7/1930 | Barthes | 36/72 B |
| 1,830,912 | 11/1931 | Ramey | 36/72 B |
| 1,945,420 | 1/1934 | Charles | 36/72 B |
| 2,745,041 | 5/1956 | Price | 36/7.2 |
| 2,894,339 | 7/1959 | Shapiro | 36/72 B |
| 3,012,393 | 12/1961 | Dinkel | 36/7.2 |
| 3,104,479 | 9/1963 | D'Amico | 36/72 B |
| 3,141,247 | 7/1964 | Mackay | 36/7.1 R |
| 4,577,418 | 3/1986 | Nagy | 36/72 B |

FOREIGN PATENT DOCUMENTS

| | | | |
|---|---|---|---|
| 620851 | 4/1927 | France | 36/72 B |
| 637526 | 5/1928 | France | 36/7.2 |
| 33983 | 4/1929 | France | 36/7.1 R |
| 2126871 | 4/1984 | United Kingdom | 36/72 B |

*Primary Examiner*—Steven N. Meyers
*Attorney, Agent, or Firm*—Henry R. Lerner

[57] ABSTRACT

A device for protecting a shoe having a rear portion with a heel, a front portion, right and left side portions and a sole, the device including a rear protecting section which substantially covers the entire area of the rear portion including the heel; a front protecting section which substantially covers the entire area of the front portion; a right side protecting section which substantially covers the entire area of the right side portion and which connects the rear protecting section and the front protecting section together; a left side connecting section which connects the rear protecting section and the front protecting section together along the left side of the shoe, the left side connecting section being stretchable to provide snug fitting of the device on different size shoes; and a removable securing strap which prevents accidental removal of the device from the shoe.

15 Claims, 3 Drawing Sheets

10
12
14
14a
16
16a
16b
18
22
23
24
26
29
30
32
34
46
48
55
58
2
3
4

SHOE PROTECTOR

BACKGROUND OF THE INVENTION

This invention relates generally to footwear protectors, and more particularly, is directed to a shoe protector to prevent scuffing and marring of the heel, rear portion, front portion and right side portion of the right shoe of the driver of an automobile.

When driving an automobile vehicle, various portions of the right shoe come into contact with the car floor and the pedals, causing scuffing of the shoe. In this regard, shoe protectors having various shapes and various structural features, are well-known in the art, but have been found, however, to protect only limited portions of the shoe.

For example, U.S. Pat. Nos. Des. 242,090; Des. 283,751; Des. 286,460; Des. 288,382; 1,442,028; 1,708,964; 1,830,912; 2,988,830; 3,066,427; 3,104,479; 4,249,321; 4,461,100; and 4,577,418 disclose devices for protecting only the heel of a shoe. Other devices that protect the heel and also extend slightly forward of the heel are disclosed in U.S. Pat. Nos. Des. 281,739 and 3,983,641. However, these latter devices also protect only a small portion of the shoe, and specifically do not protect the toe portion of the shoe. Devices which protect only the toe portion of a shoe and/or additional small portions of the shoe, are described in U.S. Pat. Nos. Des. 147,011; 461,492; 900,499; 1,304,593; 2,436,187; 2,552,700; 2,657,477; 3,319,362; and 3,324,579. These devices, however, fail to protect the heel of the shoe.

Other devices have been developed which are intended to cover both the toe and heel portions and/or other intermediate portions, of the shoe. For example, reference is made to U.S. Pat. Nos. 1,110,045; 1,620,935; 2,032,793; and 2,078,444. In many cases where the device covers the entire shoe, such as described in U.S. Pat. Nos. 1,110,045; 2,032,793; and 2,078,444, the device functions as a second shoe or an overshoe. Such devices are, however, cumbersome and uncomfortable. In actuality, it would be easier to wear a rubber stretchable overshoe, which are, however, hot and uncomfortable.

U.S. Pat. No. 1,620,935 discloses a device that covers a substantial part of the shoe. However, the device does not cover the lower and bottom part of the heel of the shoe, where most of the scuffing takes place during driving. Further, the device covers the entire sole portion of the shoe and would therefore tend to be heavy and uncomfortable. As a result, the device would impede the sensitivity of feel that a driver requires in order to control the foot pressure on the gas and brake pedals. Furthermore, there is an exposed area on the right upper side of the shoe, close to the heel, and this area is in constant contact with a raised area of the vehicle near the floor board, whereby it would be subject to substantial scuffing. Lastly, the device is not secured over the ankle of the driver and therefore tends to slip off the driver's shoe, which is dangerous and could lead to an accident.

Reference is also made to U.S. Pat. Nos. 237,887 and 559,254 which merely disclose sandal type devices which fit directly over the foot of the person.

OBJECTS AND SUMMARY OF THE INVENTION

It is an object of the present invention to provide a shoe protector which avoids the problems encountered in the prior art which constitutes a vast improvement over prior devices.

A shoe, if left unprotected, is easily scuffed when the wearer thereof is engaged in driving his car, transforming a brand new shoe into one that has clearly lost it new look, possibly in a matter of minutes.

The shoe protector in accordance with the invention provides the shoe with complete protection from scuffing, in the heel and back area, in the entire right side of the shoe where the shoe upper and sole meet to create an edge and in the entire frontal edge of the shoe.

Further, the shoe protector in accordance with the invention is provided at selected locations with expandable stretch material in order to provide adjustability and to enable the shoe protector to be put on and removed with the greatest of ease and the greatest of speed.

The left side of the shoe protector is provided with an elastic shirred strap which extends between the shoe and heel areas to provide a snug fit while at the same time providing adjustability. The heel portion of the shoe protector is constructed and/or engineered to provide some measure of rigidity and is in complementary, conformity with the heel of the shoe. The right side of the protector extends underneath the right side of the shoe to fully protect the right side edges of the shoe which are most exposed and vulnerable to scuffing during driving.

It is therefore another object of the present invention to provide a shoe protector in which the heel portion is protected on the left and right sides, the center back side and the entire bottom part thereof.

It is yet another object of the present invention to provide a shoe protector which fits snugly around shoes of all sizes.

It is a further object of the present invention to provide a shoe protector in which an elastic material connects the heel and toe protecting section to provide an adjustable fitting for shoes of different lengths.

It is a still further object of the present invention to provide a shoe protector that includes a stretchable toe protecting section that covers the entire front portion of the shoe while also providing an adjustable fitting for shoes of different sizes, such heel protecting section being an engineered constructed section adapted to conform to the heel of the shoe.

It is a yet further object of the present invention to provide a side protector that includes a stretchable heel protecting section that covers the entire rear portion of the shoe while also providing an adjustable fitting for shoes of different sizes.

It is another object of the present invention to provide a shoe protector that includes securing means that extend above the ankle of the wearer to prevent accidental removal of the shoe protector from the shoe during driving.

It is still another object of the present invention to provide a shoe protector with the aforementioned advantages that is made of a flexible material that can be compactly and conveniently stored and carried, and that is comfortable to wear.

It is yet another object of the present invention to provide a shoe protector that does not take away from the feel of the brake and gas pedals by the wearer.

In accordance with an aspect of the present invention, a protecting device for a shoe having a rear portion with a heel, a front portion, right and left side portions, and a sole includes rear protecting means for substantially covering the entire area of the rear portion including the heel; front protecting means for substantially covering the entire area of the front portion; right side protecting means for substantially covering the entire area of the right side portion and for connecting the rear protecting means and the front protecting means together; and left side connecting means for connecting the rear protecting means and the front protecting means together along the left side of the shoe; and at least one of the right side protecting means and the left side connecting means being stretchable to provide snug fitting of the shoe protector on different size shoes.

The shoe protector, in accordance with the invention, protects the driver's right shoe from scuffing at all points where the shoe would normally come into contact with the car floor, the pedals and other portions of the car interior.

The shoe protector in accordance with the invention is of light weight and is secure in place. It cannot inadvertently slip off nor does it take away from the driver's ability to feel the car pedals, such constituting a further improvement over the prior art.

The above and other objects, features and advantages of the present invention will become readily apparent from the following detailed description which is to be read in connection with the accompanying drawings.

DETAILED DESCRIPTION OF A PREFERRED EMBODIMENT

Figures 1, 2:
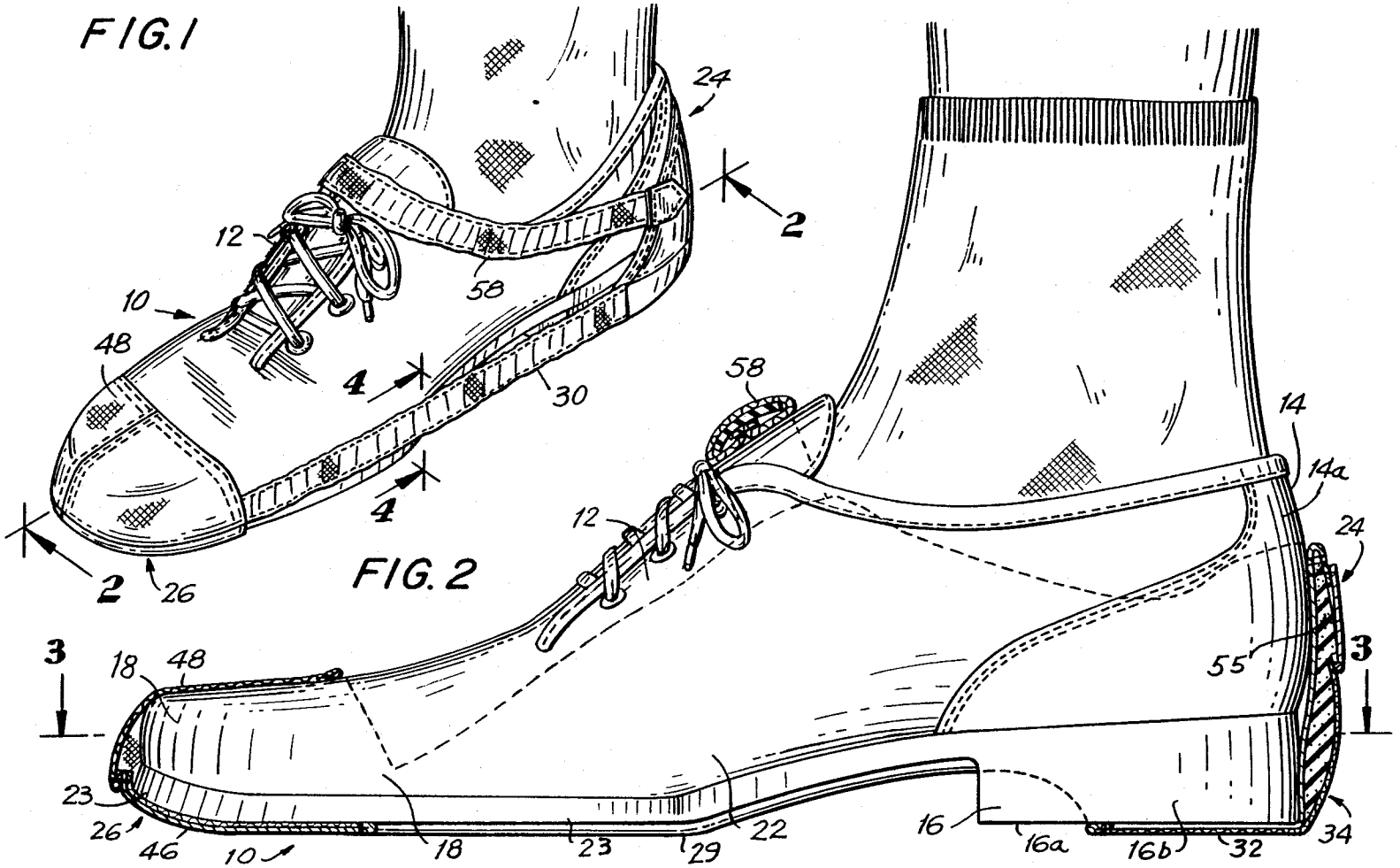
FIG. 1 is a perspective view of a shoe protector according to the present invention, shown being worn over a shoe.
FIG. 2 is a cross-sectional view of the shoe protector of FIG. 1, taken along line 2—2 thereof.
Figure 3:
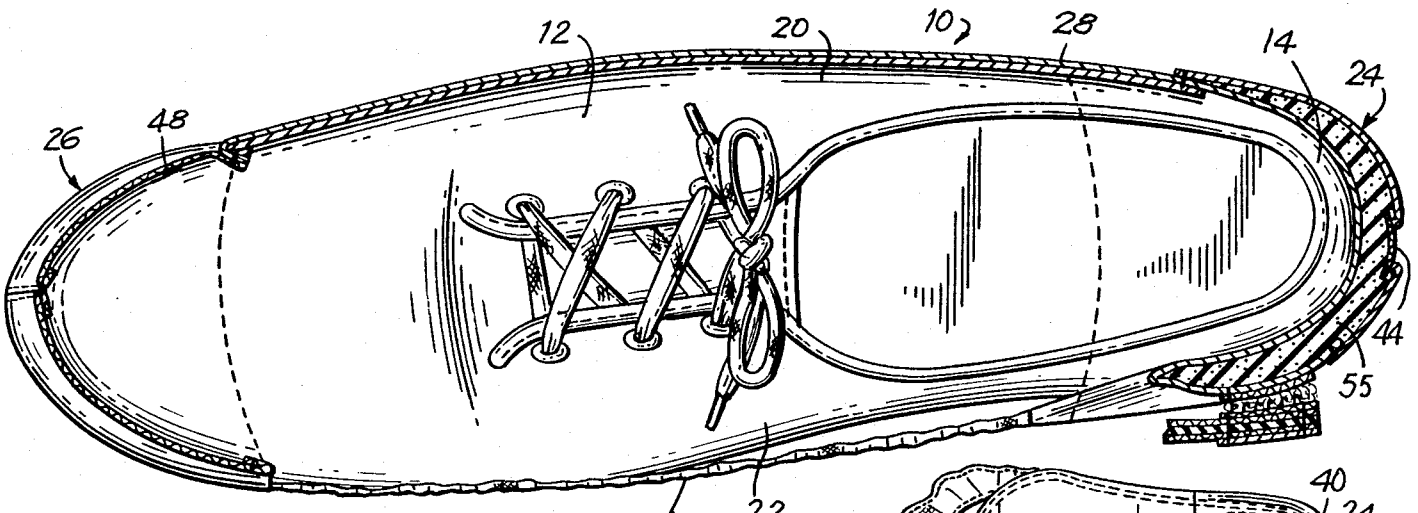
FIG. 3 is a cross-sectional view of the shoe protector of FIG. 1, taken along line 3—3 thereof.
Figure 5:
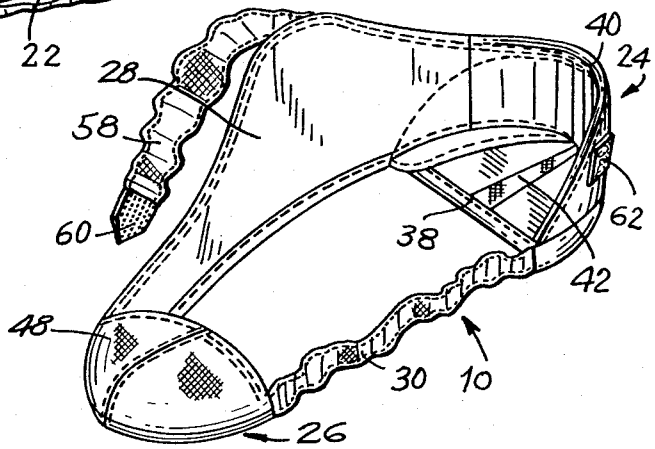
FIG. 5 is a perspective view of the shoe protector of FIG. 1, shown apart from a shoe.
Figure 4:
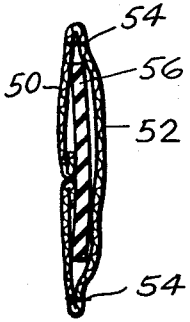
FIG. 4 is a cross-sectional view of a portion of the shoe protector of FIG. 1, taken along line 4—4 thereof.

Referring to the drawings in detail, a device 10 for protecting a shoe 12 having a rear portion 14 with a heel 16, a front portion 18, right and left sides 20 and 22, and a sole 23, generally includes a rear protecting section 24 for substantially covering the entire area of the rear portion 14 of shoe 12, a front protecting section 26 for substantially covering the entire area of the front portion 18 of shoe 12, a right shoe protecting portion 28 for substantially covering the entire right side 20 of shoe 12 and for connecting rear protecting section 24 and front protecting section 26 together, and a left side connecting section 30 for connecting rear protecting section 24 and front protecting section 26 together along the left side 22 of shoe 12.

Heel 16 includes a bottom **16*a* and a curved side wall 16*b*, and rear portion 14 also includes a curved end wall 14*a* situated above curved side wall 16*b* and connected to heel 16. Rear protecting section 24 covers bottom 16*a* and curved side wall 16*b* of heel 16 and curved end wall 14*a*. In this regard, rear protecting section 24 includes a bottom panel 32 which substantially covers bottom 16*a* of heel 16 and a curved panel 34 connected to bottom panel 32 and which substantially covers curved side wall 16*b* of heel 16 and curved end wall 14*a* of rear portion 14 of shoe 12**.

In order to permit stretching of rear protecting section 24, an elastic insert is built into it. Specifically, bottom panel 32 includes a slit 38 and curved panel 34 of rear protecting section 24 likewise includes a slit 40, slits 38 and 40 both being substantially colinear and extending along an imaginary longitudinal plane that extends substantially centrally along the length of shoe 12. Slits 38 and 40 are closed by elastic insert materials 42 and 44, respectively, to permit stretching of rear protecting section 24 in the lateral or transverse direction of shoe 12. Thus, rear protecting section 24 is adjustable to accommodate different size shoes therein. Rear protecting section 24 may be an engineered and constructed section which gives it appreciable rigidity and which has a profile complementary to the heel of the shoe.

Front protecting section 26 covers front portion 18 of shoe 12 and the forward portion of sole 23. Thus, front protecting section 26 includes a bottom panel 46 which substantially covers the forward portion of sole 23, and a curved upper panel 48 connected to bottom panel 46 and which substantially covers front setion 18 of shoe 12. Preferably, curved upper panel 48 is made from an elastic material which is similar to that of elastic insert material 42 of rear protecting section 24. This enables the front portion 18 of different size shoes to fit snugly within front protecting section 26. It is important that front protecting section 26 protect front portion 18 of shoe 12 from raised portions of the vehicle that is being driven, while also permitting the driver to adequately feel the pressure, that is, the touch, of the gas and brake pedals, thereby providing greater safety when driving.

Figure 7:
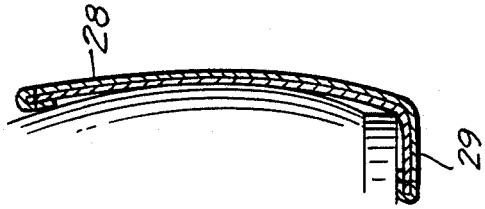
FIG. 7 is a cross-sectional view, taken along line 7—7 of FIG. 6.
Figure 6:
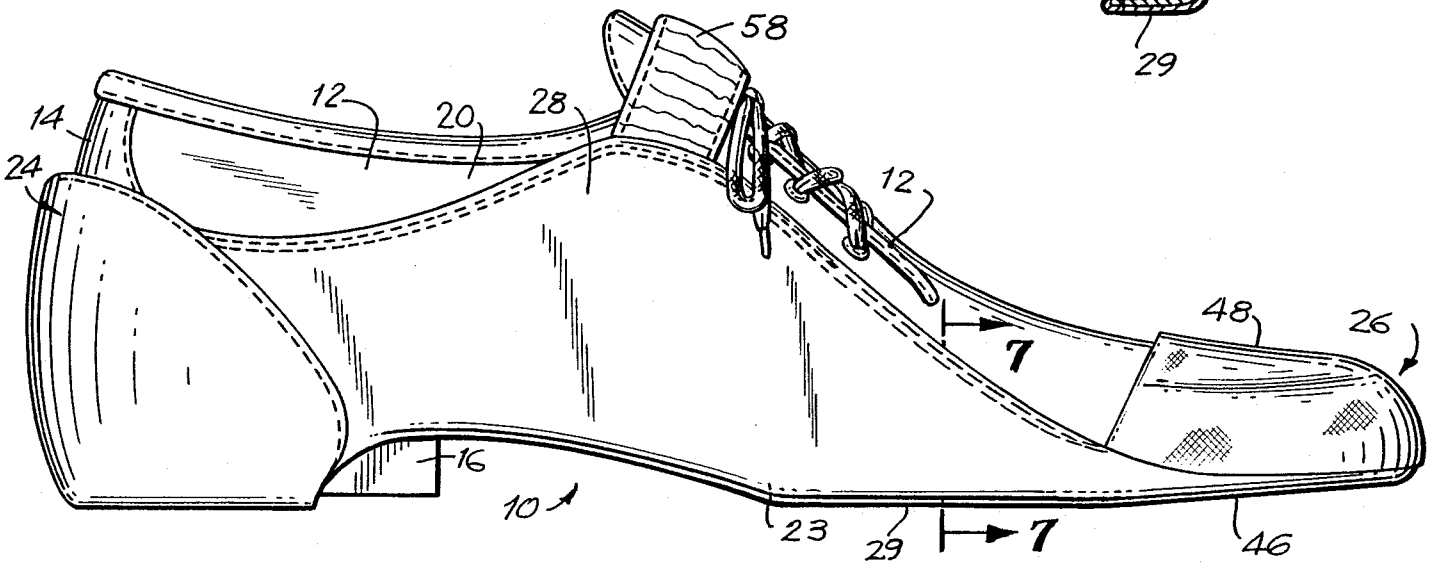
FIG. 6 is a right side elevational view of the shoe protector in FIG. 1.

Right side protecting section 28 connects the right sides of rear protecting section 24 and front portecting section 26, and in a preferred embodiment, connects the right side of curved panel 34 of rear protecting section 24 and the right side of bottom panel 46 of front protecting section 26. When driving an automotive vehicle, the right side 20 of the right shoe 12 often hits against the raised portion of the floor adjacent the gas peddle, causing scuffing and marring of the right side 20 of this shoe. It is therefore an important aspect of the present invention that right side protecting section 28 also protect substantially the entire right side 20 of shoe 12. In this regard, as best shown in FIG. 6, right side protecting section 20 substantially covers the entire right side 20 of the right shoe 12. Further, as best shown in FIG. 7, right side protecting section 28 has a portion 29 which extends inwardly under the shoe proper to protect all the right side edges of the shoe which are most vulnerable to scuffing.

Except as otherwise indicated, rear protecting section 24, front protecting section 26 and right side protecting section 28 can be made from any suitable material such as polyvinyl chloride (PVC), cloth, leather, vinyl or the like. In a preferred embodiment, these sections are constructed in two layers, such that the inner layer is formed from PVC and the outer layer is formed from leather on all areas that are subjected most to constant and intense wear, since leather is more durable than most other flexible materials. Although it is possible to use PVC as the outer layer, this material will scuff, mar and wear through in a shorter period of time than leather. Also, as shown in FIG. 2, a foam layer 55 may be provided between the two layers to provide a cushioning effect.

The left side connecting section is defined by a strap 30 which connects the left sides of rear protecting section 24 and front protecting section 26, and in a preferred embodiment, connects the left side of curved panel 34 of rear protecting section 24 and the left side of curved upper panel 48 of front protecting section 26.

In order to permit adjustment of shoe protector 10 in the lengthwise direction thereof for different size shoes, strap 30 is stretchable, as hereafter described.

More specifically, strap 30 is formed by two elongated connecting strips 50 and 52 superimposed on each other and connected to each other along their longitudinal edges by stitching 54 or the like. The front ends of strips 50 and 52 are connected to the left side of curved panel 34 of rear protecting section 24 and the rear ends of said strips are connected to the left side of curved upper panel 48 of front protection section 26. An elastic strip 56 is secured, under tension, between connecting strips 50 and 52, with elastic strip 56 also having its opposite ends connected to the left side of curved panel 34 of rear protecting section 24 and the left side of curved upper panel 48 of front protection section 26. Accordingly, strap 30 is normally shirred and, when placed on the wearer's shoes, is automatically stretched to insure a good fit.

With the structure described above, the user merely inserts front portion 18 of shoe 12 into front protecting section 26 and then extends left side connecting section 30 rearwardly to permit the rear portion 14 of shoe 12 to be positioned within rear protecting section 24. When this is done, shoe protector 10 is positioned snugly over shoe 12 to protect the same.

In order to ensure that shoe protector 10 will not accidently be removed from shoe 12 while driving, which would be hazardous, a securing strap 58 has one end connected to the upper end along right side protecting section 28, and has a securing tab 60 on the opposite free end thereof. A complementary securing tab 62 is secured to the upper left side of curved panel 34 of rear protecting section 24 for matingly engaging securing tab 60 so that strap 58 is secured over the ankle of the user to prevent accidental removal of the shoe protector 10 while driving. In a preferred embodiment, securing tabs 60 and 62 can be constructed from conventional male and female "Velcro"-elements. Securing strap 58 is stretchable, and in this regard, can be constructed in the same manner as strap 30.

Thus, with the present invention, shoe protector 10 provides complete protection to right side 12 of the driver of an automotive vehicle, and specifically protects rear portion 14 including heel 16, front portion 18, and right side 20 of shoe 12. Further, shoe protector 10 is adjustable to provide a snug fit for shoes of all sizes and is made of a lightweight and pliable material, enabling the protector to be compactly and conveniently stored and carried and enabling the wearer to retain the feel on the brake and gas pedal of the automotive vehicle. Further, the unique construction aforedescribed permits the protector device to be most easily and speedily put on and taken off.

Having described a specific preferred embodiment of the invention with reference to the accompanying drawings, it will be appreciated that the present invention is not limited to that precise embodiment, and that various changes and modifications may be effected therein by one of ordinary skill in the art without departing from the scope or spirit of the invention as defined in the appended claims.

What is claimed is:

1. A device for protecting a shoe having a rear portion with a heel, a front portion, right and left side portions and a sole, said device comprising:

rear protecting means for substantially covering the entire area of said rear portion including the heel;

front protecting means for substantially covering the entire area of said front portion;

said front protecting means being spaced from the rear protecting means a substantial distance along the bottom of the shoe so that the major portion of the sole is uncovered by the protecting device;

right side protecting means for substantially covering the entire area of said right side portion and for connecting said rear protecting means and said front protecting means together;

left side connecting means for connecting said rear protecting means and said front protecting means together along the left side of the shoe;

at least one of said right side protecting means and said left side connecting means being stretchable to provide snug fitting of said device on different size shoes.

2. a device according to claim 1; wherein the heel has a bottom and a curved side wall, and said rear portion of the shoe also includes a curved end wall positioned above the curved side wall, and said rear protecting means includes bottom panel means for substantially covering the bottom of the heel and curved panel means connected to said bottom panel means for substantially covering the curved side wall and the curved end wall of the rear portion of the shoe.

3. A device according to claim 2; wherein each of said bottom panel means and said curved panel means includes at least one slit, and said heel protecting means further includes elastic insert means for closing each slit to provide an adjustable fit around the heel of different size shoes.

4. A device according to claim 3; wherein said bottom panel means includes a first slit extending along a substantially central longitudinal plane of the shoe and said curved panel means includes a second slit extending along said longitudinal plane of the shoe and being contiguous with said first slit.

5. A device according to claim 2; wherein said bottom panel means and said curved panel means are made from a relatively flexible, non-elastic material.

6. A deivce according to claim 5; wherein said bottom panel means and said curved panel means are each made from two superposed layers, an inner one of said layers made from polyvinyl chloride and the other outer layer made from leather.

7. A device according to claim 1; wherein said front protecting means includes bottom panel means for substantially covering a forward portion of the sole of the shoe and curved upper panel means connected to said bottom panel means for substantially covering the front portion of the shoe.

8. A device according to claim 7; wherein said curved upper panel means is made from a relatively flexible, elastic material.

9. A device according to claim 1; wherein said right side protecting means has a first end connected to the right side of said rear protecting means and a second, opposite end connected to the right side of said front protecting means.

10. A device according to claim 1; wherein said left side connecting means is made from a stretchable material to permit lengthwise adjustment of said device about different size shoes.

11. A device according to claim 1; further including removable securing strap means for preventing accidental removal of said device from the shoe, said securing strap means having a free end and an opposite end connected to one of said right side protecting means and said rear protecting means, said free end having first securing means thereon, and said device further including second securing means on the other of said right side protecting means and said rear protecting means for engaging said first securing means so as to secure said securing strap means about a respective ankle of a wearer of the device.

12. A device according to claim 11; wherein one of said first and second securing means includes a plurality of fabric hooks and the other of said first and second securing means includes a fabric engageable by said hooks.

13. A device according to claim 1; wherein said right side protecting means includes a portion extending underneath the shoe so as to protect the right side edge of the shoe.

14. A device according to claim 1; wherein said rear protecting means comprise a constructed semi-rigid heel receiving section complementary to the heel of the shoe.

15. A device according to claim 1; wherein the heel has a bottom and a curved side wall, and said rear portion of the shoe also includes a curved end wall positioned above the curved side wall, and said rear protecting means includes bottom panel means for substantially covering the bottom of the heel and curved panel means connected to said bottom panel means for substantially covering the curved side wall and the curved end wall of the rear portion of the shoe, said curved panel means terminating in front portions unattached to each other to enable the shoe of the user to be inserted in the device without interference.

* * * * *